US006054658A

United States Patent [19]

Duhon et al.

[11] Patent Number: 6,054,658

[45] Date of Patent: Apr. 25, 2000

[54] ELECTRICAL SWITCH MAT

[75] Inventors: Edward W. Duhon, Setauket; Joseph O. Kundler, Glenwood Landing; Rudolph R. Baldeo, North Babylon, all of N.Y.

[73] Assignee: Tapeswitch Corporation, Farmingdale, N.Y.

[21] Appl. No.: 09/088,689

[22] Filed: Jun. 1, 1998

[51] Int. Cl.[7] ..... H01H 3/02

[52] U.S. Cl. ..... 200/86 R

[58] Field of Search ..... 200/85 R, 86 R, 200/86 A, 85 A, 86.5

[56] References Cited

U.S. PATENT DOCUMENTS

| | | | |
|---|---|---|---|
| Re. 24,541 | 9/1958 | Koenig . | |
| 2,813,163 | 11/1957 | Durbin | 200/86 R |
| 2,896,042 | 7/1959 | Koenig . | |
| 2,938,977 | 5/1960 | Koenig . | |
| 2,954,446 | 9/1960 | Wikkerink | 200/86 R |
| 3,243,540 | 3/1966 | Miller . | |
| 3,283,096 | 11/1966 | Horton . | |
| 3,412,224 | 11/1968 | Koenig . | |
| 3,596,024 | 7/1971 | Smith et al. | 200/86 R X |
| 3,694,600 | 9/1972 | Koenig . | |
| 3,710,054 | 1/1973 | Koenig . | |
| 3,717,735 | 2/1973 | Koenig . | |
| 3,722,086 | 3/1973 | Wikkerink et al. . | |
| 3,825,277 | 7/1974 | Steinback | 200/86 R |
| 3,862,389 | 1/1975 | Lowe | 200/86 R |
| 4,293,752 | 10/1981 | Koenig | 200/295 |
| 4,497,989 | 2/1985 | Miller . | |
| 4,987,277 | 1/1991 | Duhon . | |
| 5,001,310 | 3/1991 | O'Meara, Jr. et al. . | |
| 5,142,109 | 8/1992 | O'Meara, Jr. et al. . | |
| 5,510,586 | 4/1996 | Hacking . | |
| 5,602,428 | 2/1997 | Schultz et al. | 307/119 |
| 5,795,059 | 8/1998 | Boon | 200/85 R |

OTHER PUBLICATIONS

Tapeswitch Corporation's Catalog C–17–A concerning Press–At–Any–Point Sensing Switches, Date of Publication: before Apr. 1, 1997; Place of Publication: United States.

Tapeswitch Corporation's Literature concerning Tapeswitch Press–At–Any–Point Traction Optimizer Switching Mats; Date of Publication: before Apr. 1, 1997 ; Place of Publication: United States.

*Primary Examiner*—Renee Luebke
*Attorney, Agent, or Firm*—Hoffman & Baron, LLP

[57] ABSTRACT

An electrical switch mat which includes an electrical contact, a support frame, and a plate member. The electrical contact is operable under pressure between a closed condition and an open condition and is maintained in either the opened or closed condition in the absence of pressure. The support frame defines a two-dimensional area and is formed with a protective housing to prevent excessive compression from being transmitted to the components of the electrical contact during activation. The plate member is sized to fit within the two-dimensional area of the support frame and is supported at its perimeter by the support frame. The plate member transmits activating compression to the electrical contact. The electrical contact can be a ribbon switch that may either run substantially continuously or be placed intermittently along the perimeter of the plate member. The ribbon switch includes a pair of vertically spaced electrical conductors enclosed in an insulative jacket such that the conductors are urged into electrical engagement upon compressing the plate member to activate the ribbon switch. The protective housing is generally channel shaped and the electrical contact is positioned within the channel.

36 Claims, 12 Drawing Sheets

ELECTRICAL SWITCH MAT

BACKGROUND OF THE INVENTION

The present invention relates generally to pressure activated switches, and more particularly, the present invention is directed to an electrical switch mat.

Various types of electrical switch mats are known in the art. Electrical switch mats have been designed for use in many different applications including use in floor mats for security, safety or other purposes to detect movement of objects or pedestrian traffic thereover. Another application of switch mats includes the placement in passenger seats for actuation when a person sits in the seat; and yet another application involves placement of a pressure switch in the street surface for the detection of traffic flow.

Electrical switches have been incorporated within several types of mats in order to protect the switches from wear and other potentially adverse effects such as moisture. Included among such mat switches are those shown in U.S. Pat. No. 2,938,977 to Koenig, U.S. Pat. No. 3,243,540 to Miller, U.S. Pat. No. 3,283,096 to Horton (which corresponds to Canadian patent 787,520), U.S. Pat. No. 4,497,989 to Miller, and U.S. Pat. Nos. 5,001,310, and 5,142,109, each issued to O'Meara, Jr. et al.

U.S. Pat. No. 2,938,977 to Koenig discloses an electric switching mat having a bottom sheet of insulating material, a plurality of upper and lower contact strips separated by insulating strips, and an upper sheet of insulating material placed over the strips thereby sandwiching the strips between the upper and lower sheets.

U.S. Pat. No. 3,243,540, to Miller discloses an electric mat switch incorporating compressible protective layers made of foam rubber or the like.

U.S. Pat. No. 3,283,096, to Horton discloses a mat switch having a single sealed envelope for the switch element. The membranes of the switch element are themselves relatively thick members made from glass fiber-reinforced synthetic polymer in order to prevent buckling and shorting of the contact elements.

U.S. Pat. No. 3,722,086 to Wikkerink, et al. discloses a process for making floor mat switches made of two contact plates formed of sheets of slight gauge spring steel which are spaced apart by a plurality of dielectric pads. Additionally, a band of dielectric material is positioned between the peripheral edges of the contact plates.

U.S. Pat. No. 4,497,989, to Miller discloses an electric mat switch wherein two conductor layers are separated by a separator layer of PVC foam. The electric mat switch also comprises a top outer layer and a separate moisture layer formed of PCV, an upper bulking layer formed of fiberglass fabric, all of which are disposed above the conductor layers. Below the conductor layers are a corresponding lower bulking layer formed of fiberglass fabric, a lower moisture layer, and a lower outer layer.

U.S. Pat. Nos. 5,001,310 and 5,142,109, each issued to O'Meara, Jr. et al., show a pressure-actuated electrical switching mat having a moisture resistant switching chamber. This switching chamber is protected by a puncture resistant protective layer.

Electrical ribbon switches have been incorporated into numerous designs for electrical switch mats. U.S. Pat. Nos. Re. 24,541, 2,896,042, 3,412,224, 3,694,600, and 3,710,054, each to Koenig show various constructions of open pressure sensitive ribbon switches, the disclosure of which are incorporated herein by reference. U.S. Pat. No. 3,717,735 to Koenig and U.S. Pat. No. 4,987,277 to Duhon illustrate various constructions for a closed pressure sensitive ribbon switches, the disclosure of which are incorporated herein by reference. Both the open and closed pressure sensitive ribbon switches generally include a pair of either spaced or closed conductors respectively supported in an insulative jacket. Generally, relatively light pressure on the jacket will close the space in an open switch and open the conductors in a close switch thereby activating the switch.

In connection with the traditional style electrical switch mats described above, U.S. Pat. No. 5,510,586 to Hacking discloses a switch joint for use between a pair of electrical switch mats. The switch joint uses an electrical ribbon switch to provide pressure-sensitive continuity between a pair of electrical switch mats.

Electrical switch mats as described above have been useful, however, they are generally not field repairable allowing for the replacement of worn or damaged parts. Further, a problem associated with the traditional style electric mat is that when a pair of electrical switch mats are used next to each other there is an inactive zone unless a switch joint such as, for example, the apparatus disclosed in U.S. Pat. No. 5,510,586 to Hacking is used.

SUMMARY OF THE INVENTION

The present invention is an electrical switch mat which comprises an electrical contact, a support frame, and a plate member. The electrical contact is operable under pressure between a closed condition and an open condition and is maintained in either the opened or closed condition in the absence of pressure. The support frame defines a two-dimensional area and is formed with a protective housing dimensioned to house the electrical contact for activating under pressure and to prevent excessive compression from being transmitted to the components of the electrical contact during activation. The plate member is defined by a perimeter that is sized to fit within the two-dimensional area of the support frame and is supported at its perimeter by the support frame. The plate member transmits activating compression to the electrical contact. Preferably, the plate member is shaped to be supported substantially continuously along its perimeter.

In a preferred embodiment the electrical contact is a ribbon switch. The ribbon switch may either run substantially continuously along the perimeter of the plate member or alternatively may be placed intermittently along the perimeter of the plate member. Preferably, the ribbon switch includes a pair of vertically spaced electrical conductors enclosed in an insulative jacket such that the conductors are urged into electrical engagement upon compressing the plate member to activate the ribbon switch.

In another preferred embodiment, the protective housing is generally channel shaped and the electrical contact is positioned within the channel. Preferably, the electrical switch mat further comprises a dust cover attached to the support frame and sealingly engaged with the plate member. The electrical switch mat may also include a plurality of plate-member supports attached to the plate member to prevent excessive deformation of the plate member and a dust barrier may be attached to the support frame. The electrical switch mat may further include a zone separator for partitioning the plate member, and the support frame may also include a ramp.

In a further preferred embodiment of the invention, the electrical switch mat includes an electrical contact, a support frame, a plurality of plate members, and at least one connection strip. The connection strip is for joining adjacent portions of the plurality of plate members so that the plurality of plate members respond as one integral part when subjected to pressure.

As a result of the present invention, an electric switch mat is provided which is field repairable and provides protection to the critical internal components of the electrical contact. In particular, the construction of the electrical switch mat allows for the easy removal of the plate member to gain access to the electrical contact when repairs need to be made. Further, the channel shaped protective housing prevents the electrical contact from being damaged yet does not interfere with the operation of the electrical contact.

Another advantage of the present invention is that the electrical switch mat can generally be tailored to suit any particular user's dimensional needs. The present invention contemplates that standard sizes of the electrical switch mat can be preassembled and delivered to a site for standard applications. The present invention, however, is also well suited for customized installations which are not readily provided by the equipment presently meeting standards in the industry. For such installations, the unassembled components or partially assembled components can be delivered to the site for field personnel to tailor the component parts of the electrical switch mat to suit the field conditions.

For a better understanding of the present invention, reference is made to the following description to be taken in conjunction with the accompanying drawings and its scope will be pointed out in the appended claims.

BRIEF DESCRIPTION OF THE DRAWINGS

Preferred embodiments of the invention have been chosen for purposes of illustration and description and are shown in the accompanying drawings, wherein.

DETAILED DESCRIPTION OF THE INVENTION

Figure 1:
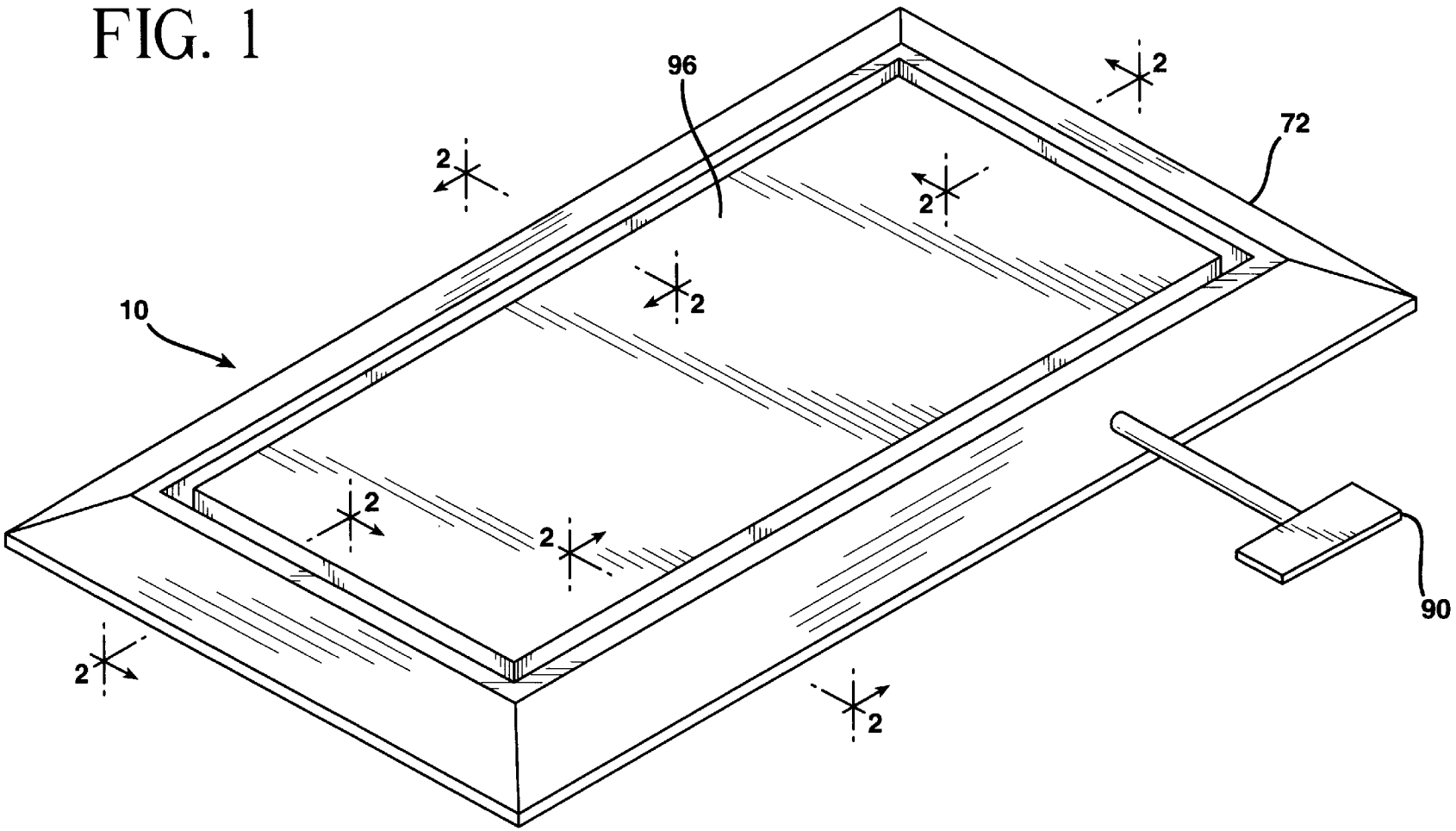
FIG. 1 is a perspective view of an electrical switch mat.
Figure 2:
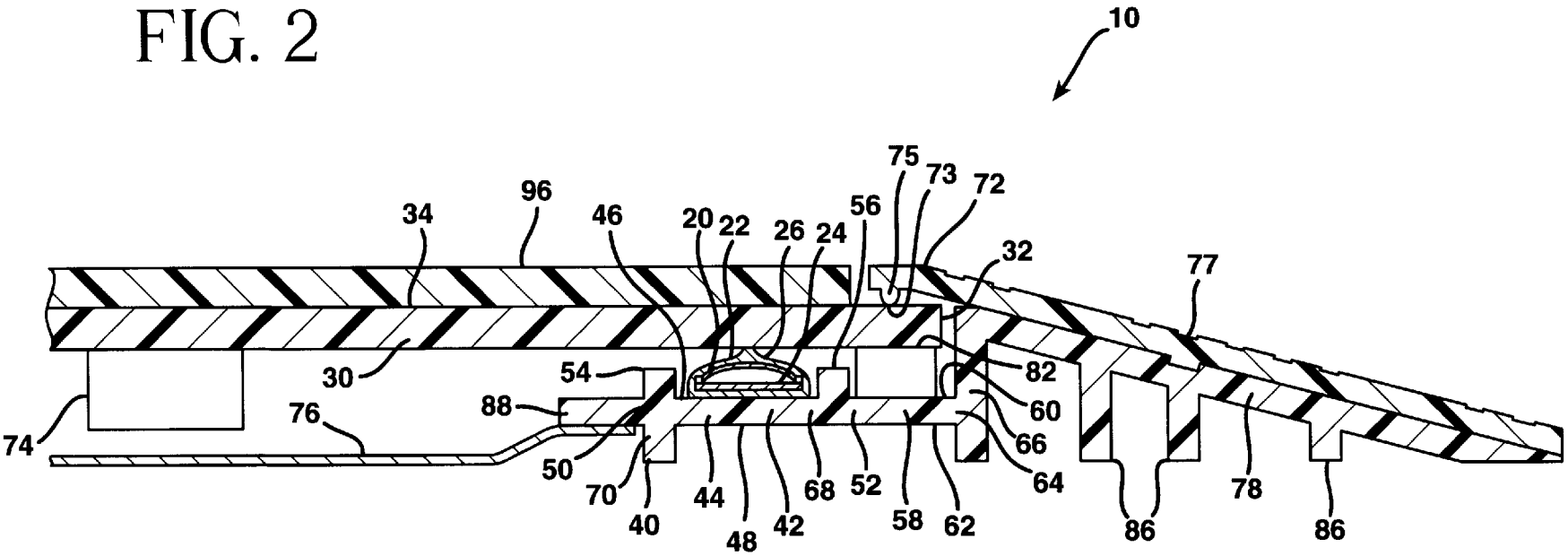
FIG. 2 is a sectional view taken along line 2—2 of FIGS. 1, 1A and 3 at the perimeter of the electrical switch mat showing an open style ribbon switch.

Initially referring to FIGS. 1 and 2, an electrical switch mat 10 in accordance with the present invention is depicted. The mat 10 includes an electrical contact 20, a support frame 40, and a plate member 30, and, preferably, a plurality of elastic members 82 and a plurality of plate member supports 74. The electrical switch mat 10 is typically connected to a signal receiver 90 such that when pressure is applied to the plate member 30, an electrical switch is activated sending a signal to the signal receiver 90.

Figure 2A:
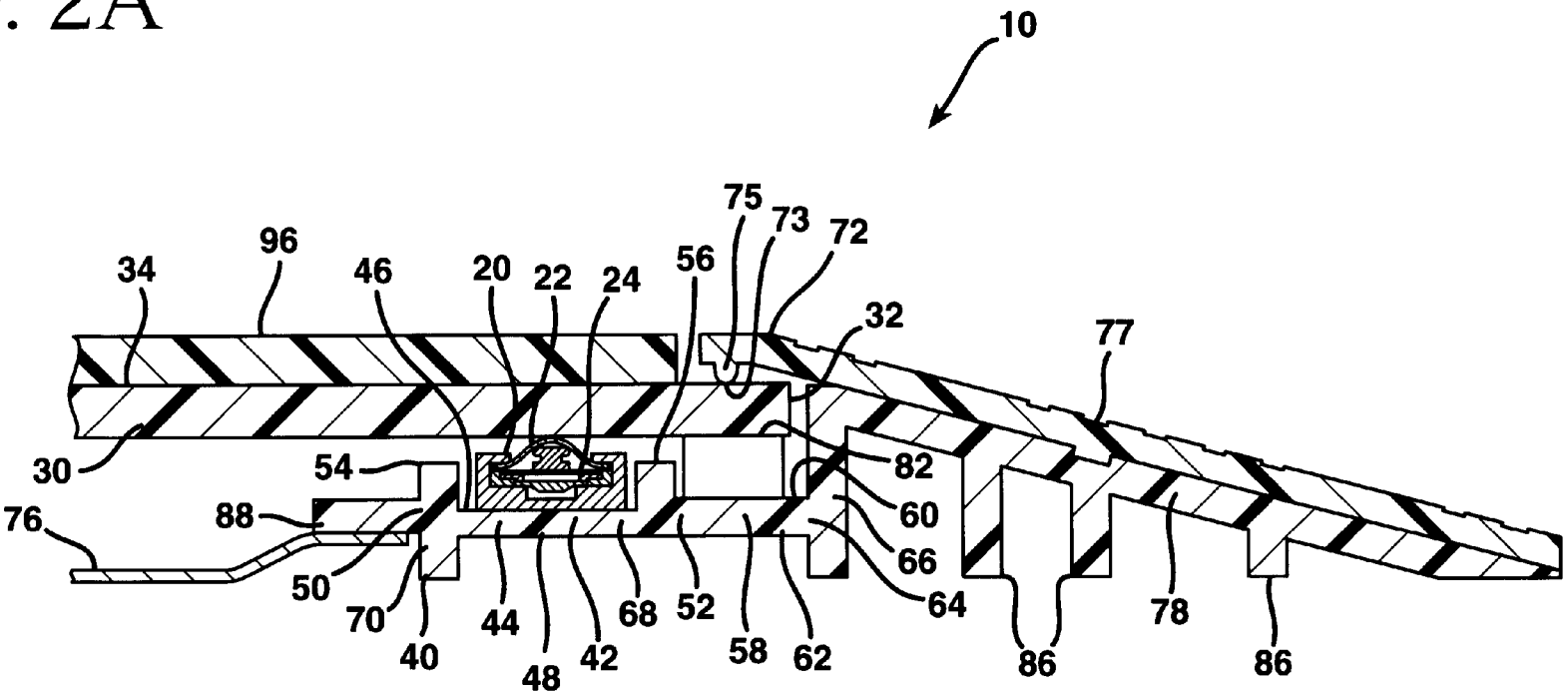
FIG. 2A is a sectional view taken along line 2—2 on FIGS. 1, 1A and 3 at the perimeter of the electrical switch mat showing a closed style ribbon switch.

The electrical contact 20 is operable under pressure between a closed condition and an open condition and is maintained in either the opened or closed condition in the absence of pressure, and can be configured to support the plate member 30 to maintain either the opened or closed condition in the absence of pressure. In a preferred embodiment, the electrical contact 20 is a conventional ribbon switch 22 as described in the above-referenced patents. The ribbon switch 22 can be either an open or closed style switch depending upon the type of the electrical switch mat 10. As shown in FIG. 2, an open style ribbon switch 22 generally includes a pair of vertically spaced electrical conductors 24 enclosed in an insulative jacket 26. Compression applied to the plate member 30 transfers pressure to the insulative jacket 26 causing the pair of electrical conductors 24 to move into electrical engagement, thereby sending a signal to a signal receiver 90. FIG. 2A shows a closed style ribbon switch 22 as disclosed in U.S. Pat. No. 4,987,277 to Duhon, the disclosure of which has been previously incorporated herein by reference. The closed style ribbon switch 22 generally includes a plurality of electrical conductors 24 arranged in an overlapping initially closed electrical engagement such that pressure applied to the ribbon switch 22 interrupts the electrical engagement which is detected by the signal receiver 90.

Figure 8:
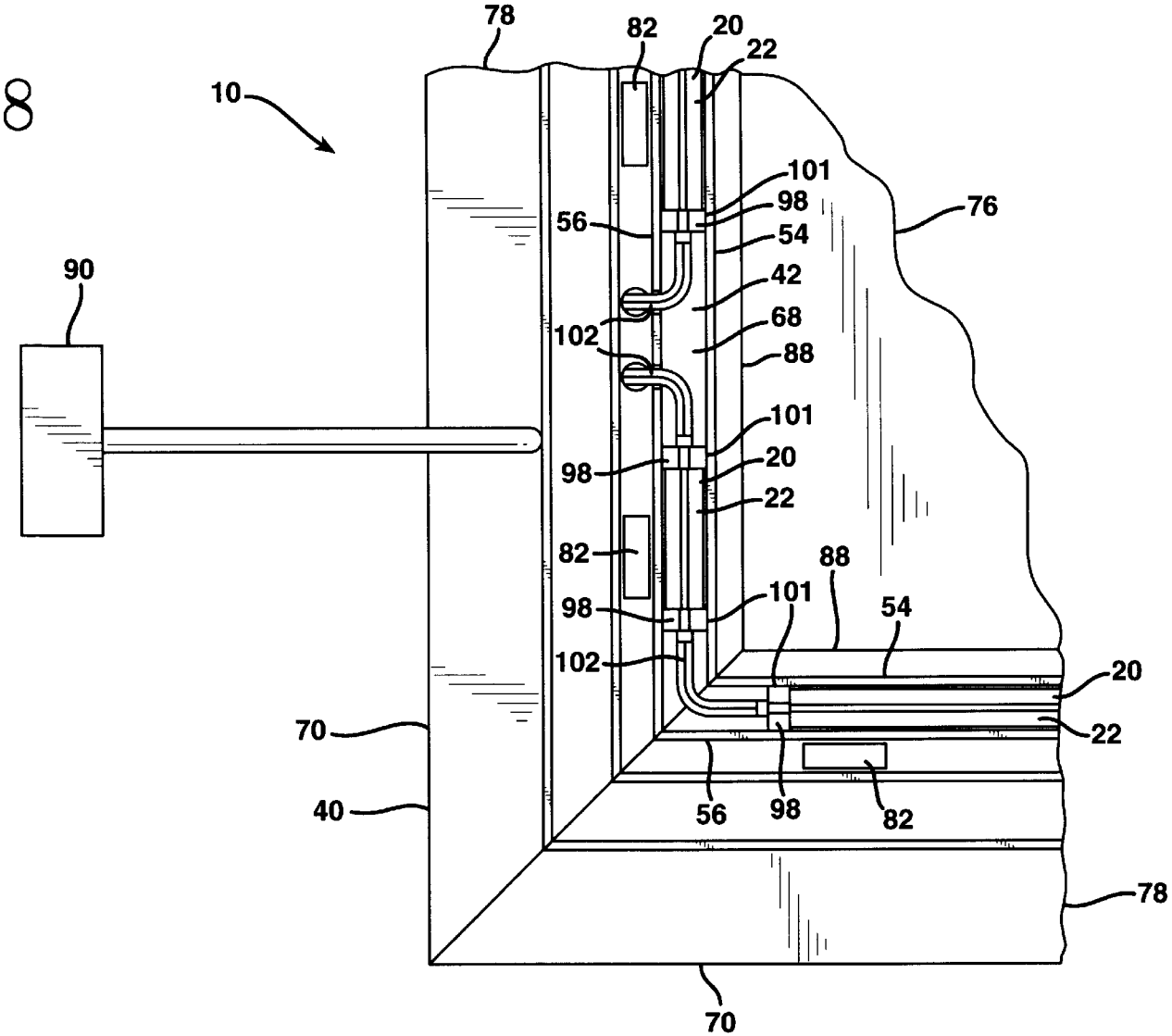
FIG. 8 is a plan view of a corner of the electrical switch mat showing the support frame with the plate member and dust cover removed.
Figure 9:
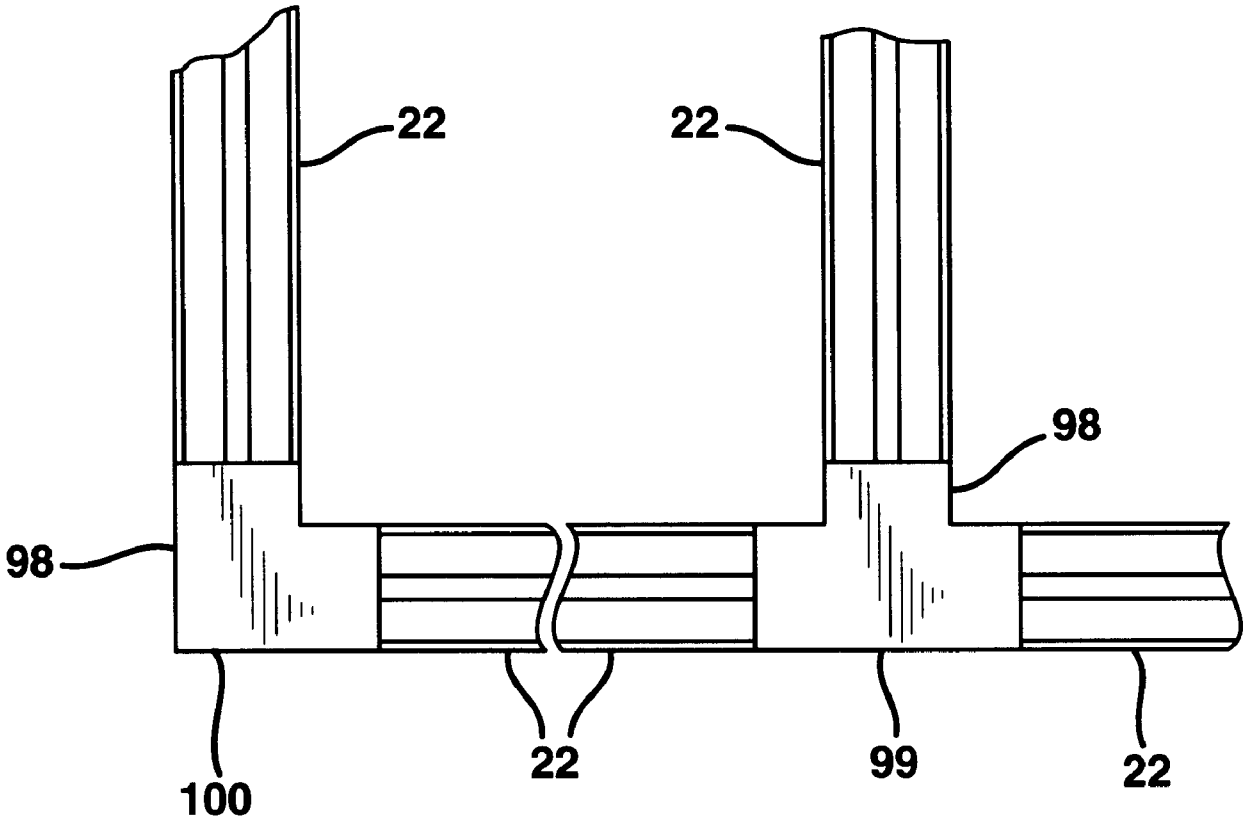
FIG. 9 is a plan view showing portions of the ribbon switch connected with 'T' and 'L' Connectors.
Figure 10:
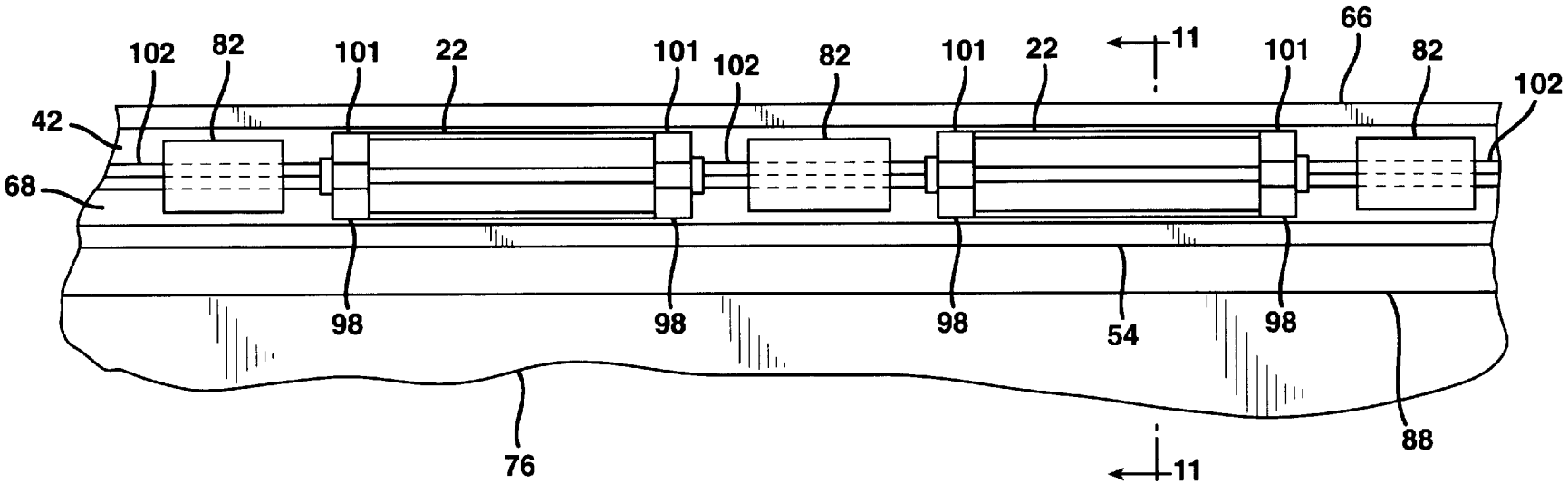
FIG. 10 is a plan view showing a ribbon switch intermittently placed with the plate member and dust cover removed.

The ribbon switch 22 is housed within a protective housing 42 of the support frame 40 which extends along the perimeter 32 of the plate member 30. When using an open style ribbon switch 22, ribbon-switch connectors 98 known in the art and considered standard to the industry for ribbon switches can be used to maintain electrical continuity in the ribbon switch 22 at the corners of the support frame 40. Ribbon-switch connectors 98 suitable for this purpose are "'T' and 'L' Connectors" 99,100 or "Molded Terminals" 101 for ribbon switches, as manufactured by Tapeswitch Corporation, Farmingdale, N.Y. and illustrated in Tapeswitch Corporation's Catalog C-17-A, or the like. As shown in FIG. 9, the 'T' and 'L' Connectors 99, 100 provide an electrical splice connection for rectangular patterns. As shown in FIG. 8, the Molded Terminals 101 can be used with wire leads 102 to provide an electrical splice connection for all patterns. The ribbon switch 22 can either be configured to run substantially continuously or intermittently placed along the perimeter 32 of the plate member 30. When the ribbon switch 22 is intermittently placed the intermittent-sections of ribbon switch 22 can be spliced together using Molded Terminals 101 along with wire leads 102 to maintain electrical conductivity between electrical conductors of the intermittent-sections of ribbon switch 22 as shown in FIG. 10. When using a closed style ribbon switch 22, the electrical continuity in the ribbon switch 22 can be maintained by simply using wire leads for all patterns.

Figure 6:
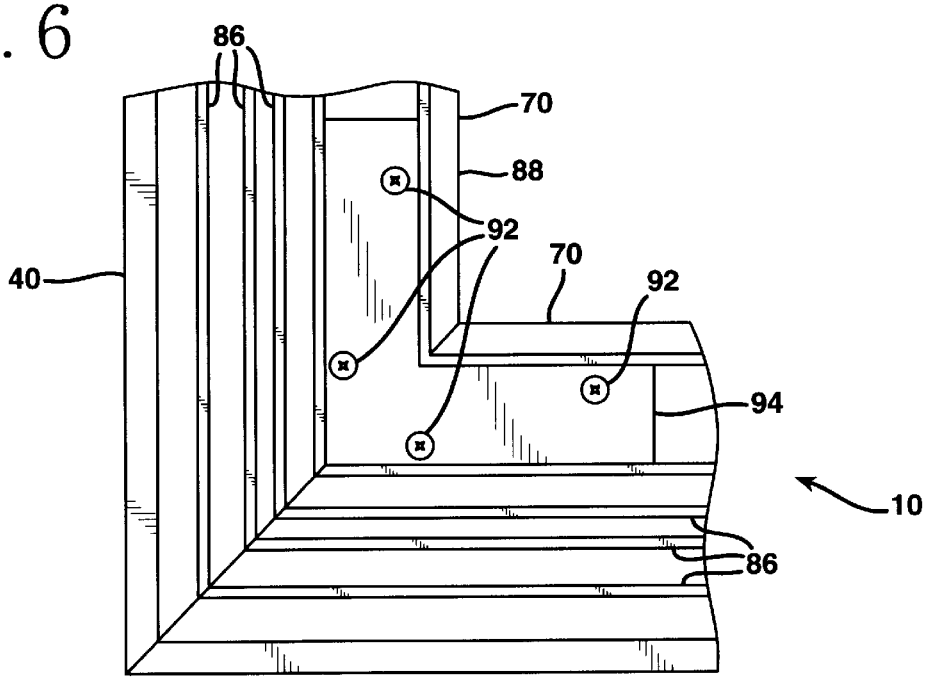
FIG. 6 is a bottom plan view at a corner of the electrical switch mat showing a connection for the mechanical fastening of the frame members of the support frame.
Figure 7:
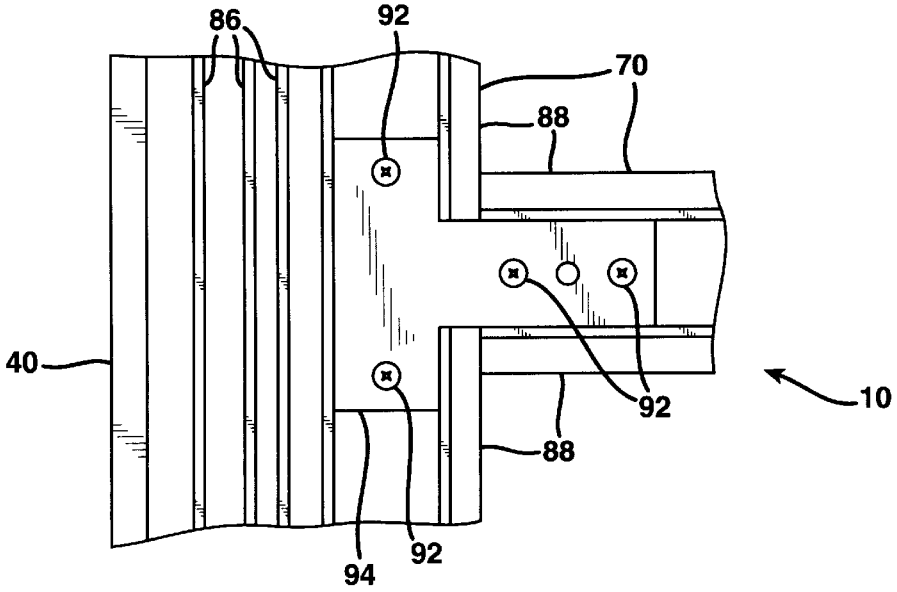
FIG. 7 is a bottom plan view of the electrical switch mat showing a connection for the mechanical fastening of the frame members of the support frame.

Referring now to FIGS. 1 and 2, the support frame 40 defines a two-dimensional area and is formed with a protective housing 42 dimensioned to house the electrical contact 20. The protective housing 42 prevents excessive compression that damages the components of the electrical contact 20 from being transmitted to the electrical contact 20 during activation. The protective housing 42 is generally channeled shaped with the electrical contact 20 being positioned within the channel 68. The support frame 40 is preferably made from a plurality of aluminum frame members 70 that can be sized to fit the particular needs of the electric mat user. The frame members 70 can be connected together by either mechanical fastening using screws 92 and brackets 94 as illustrated in FIGS. 6 and 7 or by welding. Although FIG. 1 illustrates a rectangular electrical switch mat 10 having substantially linear frame members 70, the present invention contemplates that the frame members 70 can also be curved to accommodate the particular needs of the electric mat user.

Referring again to FIGS. 1 and 2, the plate member 30 is defined by a perimeter 32 and is sized to fit within the two-dimensional area defined by the support frame 40 while being supported at its perimeter 32 by the support frame 40. The plate member 30 is preferably made out of aluminum because aluminum is relatively light in weight when compared with its modulus of elasticity for bending strength and its resistance to wear. The plate member 30 transmits activating compression to the electrical contact 20 in the presence of pressure on the plate member 30. Preferably the plate member 30 is shaped to be supported substantially continuously along its perimeter 32. The plate member 30 may also be covered with a flooring material 96 as shown in FIG. 2.

In a preferred embodiment, the electrical switch mat 10 also includes a plurality of plate-member supports 74 attached to the bottom of the plate member 30 as shown in FIG. 2. Preferably the plate-member supports 74 are made out of aluminum, or the like, and are mechanically fastened to the plate member 30. A screw or rivet are suitable fasteners for this purpose. Alternatively, the plate-member supports 74 could be made out of a plastic or a polymer having a high compressive strength and resiliency for impact loads while being attached with an appropriate adhesive such as epoxy. The plate-member supports 74 have a thickness and can be generally any shape including circular, square or rectangular. The thickness of the plate-member supports 74 is selected to insure that in the presence of pressure the plate member 30 can freely deflect to transmit activating compression to the electrical contact 20. Once the electrical contact 20 has been activated the plate-member supports 74 restrain the further deflection and deformation of the plate member 30 by biasing against the surface upon which the electrical switch mat 10 is laid. The spacing of the plate-member supports 74 is dependent upon the thickness of the plate member 30, the size of two-dimensional area defined by the support frame 40, and the anticipated compressive loading sustained from the traffic which will be applied to the plate member 30. It has been found that a spacing of 6 inches (15.2 cm) on center in both directions is advantageous when using an aluminum plate member 30 which is 0.187 inch thick with a two-dimensional area being 4 feet (1.22 m) by 8 feet (2.44 m) for use with heavy moving loads.

In a preferred embodiment, the electrical switch mat 10 also includes a plurality of elastic members 82 for biasing the plate member 30 with respect to the support frame 40. The elastic members 82 are preferably formed from open cell foam. The amount and location of the elastic members 82 can be varied to adjust the sensitivity of the electrical switch mat 10.

Generally to accommodate the ribbon switch 22 and the elastic members 82 the protective housing 42 preferably includes a base 44, a first flange 54, a second flange 56, a biasing-support member 58, and a perimeter boundary 66 as shown in FIG. 2. The base 44 has an upper surface 46, an outer surface 48, an inside boundary 50 and an outside boundary 52. The first flange 54 extends upwards from the upper surface 46 of the base 44 at the inside boundary 50. The second flange 56 extends upwards from the inner surface 46 of the base 44 at the outside boundary 52. The biasing-support member 58 extends from the outside boundary 52 of the base 44 and has a top surface 60, a bottom surface 62, and an outer end 64. The perimeter boundary 66 extends upwards from the outer end 64 of support member 58. The ribbon switch 22 is supported on the upper surface 46 of the base 44 between the first and second flanges 54, 56. The first and second flanges 54, 56 serve to prevent excessive compression from being transmitted by the plate member 30 to components of the ribbon switch 22 during activation. A plurality of elastic members 82 are seated on the top surface 60 of the biasing-support member 58 between the second flange 56 and the perimeter boundary 66.

Figure 11:
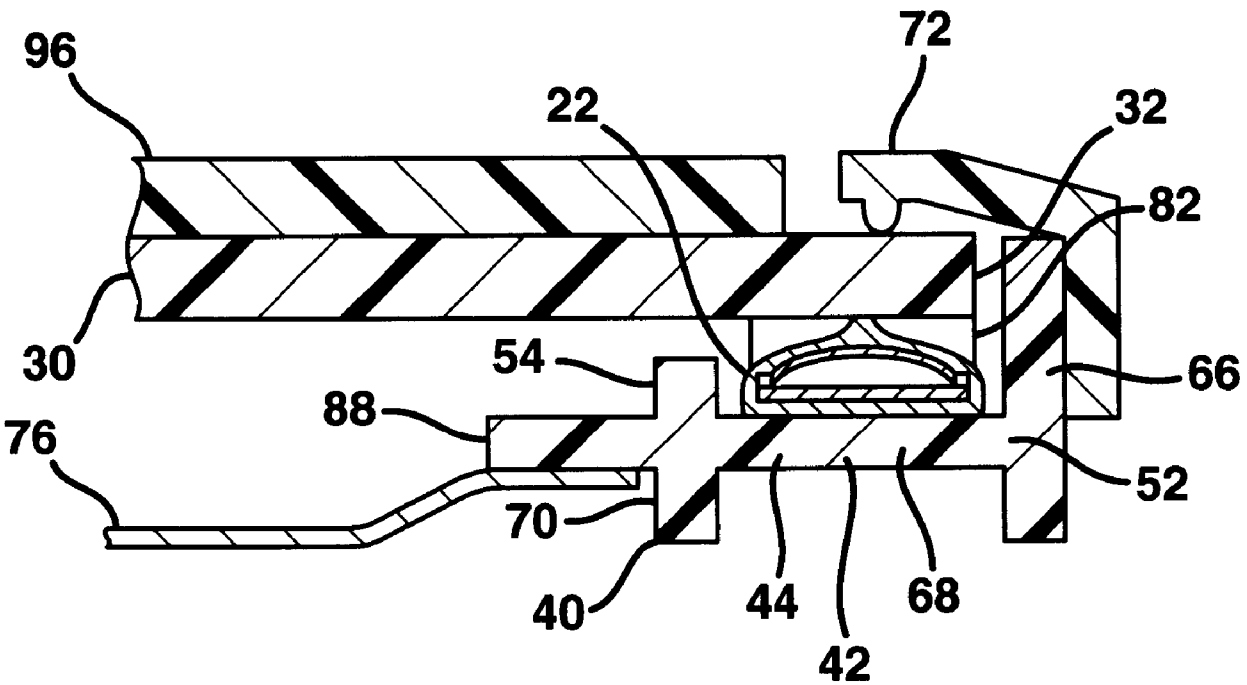
FIG. 11 is a sectional view taken along line 11—11 on FIG. 10 at the perimeter of the electrical switch mat with the plate member and dust cover included.

Referring now to FIGS. 10 and 11, in an alternative embodiment where a ribbon switch 22 is intermittently placed along the perimeter 32 of the plate member 30 as described above, a plurality of elastic members 82 can be placed between the intermittent-sections of ribbon switch 22. In this configuration both the intermittent-sections of ribbon switch 22 and the plurality of elastic members 82 will both be located within the channel 68. The channel 68 will include a base 44, a first flange 54, and either a second flange 56 or a perimeter boundary 66 that extends upwards from the outside boundary 52 of the base 44. In an embodiment that includes the second flange 56, both the first and second flanges 54, 56 will serve to prevent excessive compression from being transmitted by the plate member 30 to components of the ribbon switch 22 during activation. As shown in FIG. 11, in an embodiment which includes the perimeter boundary 66, only the first flange 54 will serve to prevent excessive compression from being transmitted by the plate member 30 to components of the ribbon switch 22 during activation. In this latter embodiment, the thickness of the plate member 30 must be selected while keeping in mind the point loads that a user anticipates the electric switch mat 10 will encounter to insure that excessive compression is not transmitted by the plate member 30 to components of the ribbon switch 22 during activation.

Preferably, the electric switch of the present invention also includes a dust cover 72 as shown in FIGS. 1 and 2. The dust cover 72 is attached to the support frame 40 and sealingly engages the plate member 30 by contact of, for example, the bottom edge 73 of a depending rib 75 to prevent foreign objects and moisture from entering the internal cavity of the electrical switch mat 10. The dust cover 72 is preferably made from a material that is wear resistant and also resilient such as PVC. The dust cover 72 is preferably mechanically fastened to the support frame with threaded screws so that the dust cover 72 can easily be removed when making repairs. As shown in FIG. 2, a ramp 78 can also be formed along the support frame 40 to facilitate pedestrian traffic and objects which are rolled across the electric switch mat 10. The ramp 78 can be formed as a solid section or preferably formed with a plurality of ramp support members 86 as shown in FIG. 2. The dust cover 72 as shown in FIG. 2 can be provided with a skid resistant surface such as a plurality of grooves 77. In order to seal the bottom of the electrical switch mat 10 a dust barrier 76 is preferably provided. The dust barrier 76 is formed from a plastic fabric and is attached at the base 44 of the protective housing 42. Preferably the protective housing 42 includes a base-extension member 88 extending from the inside boundary 50 of the base 44 to facilitate the attachment of the dust barrier 76 to the protective housing 42.

Figure 1A:
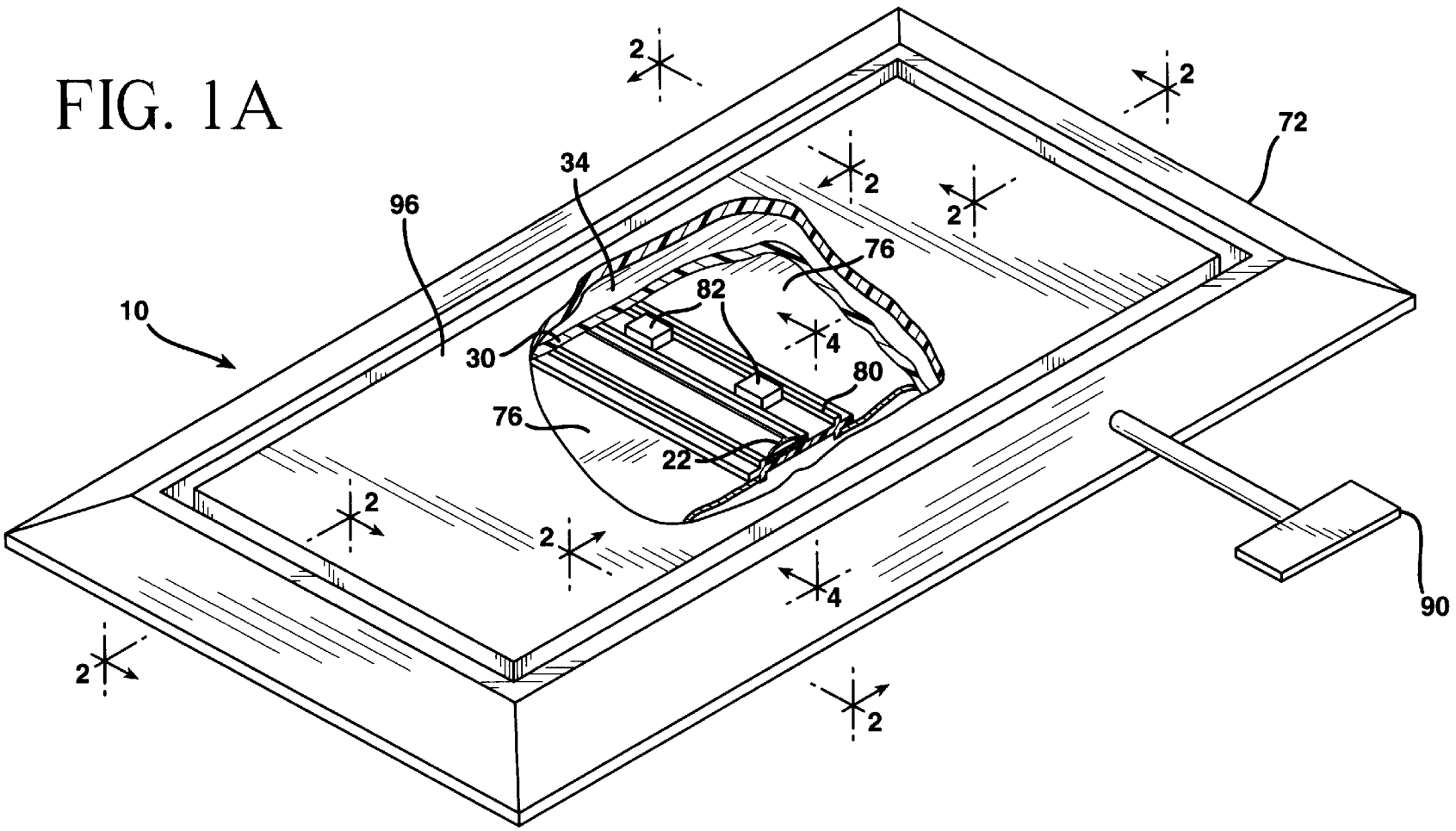
FIG. 1A is a perspective view of an electrical switch mat with sections removed showing a zone separator.
Figure 4:
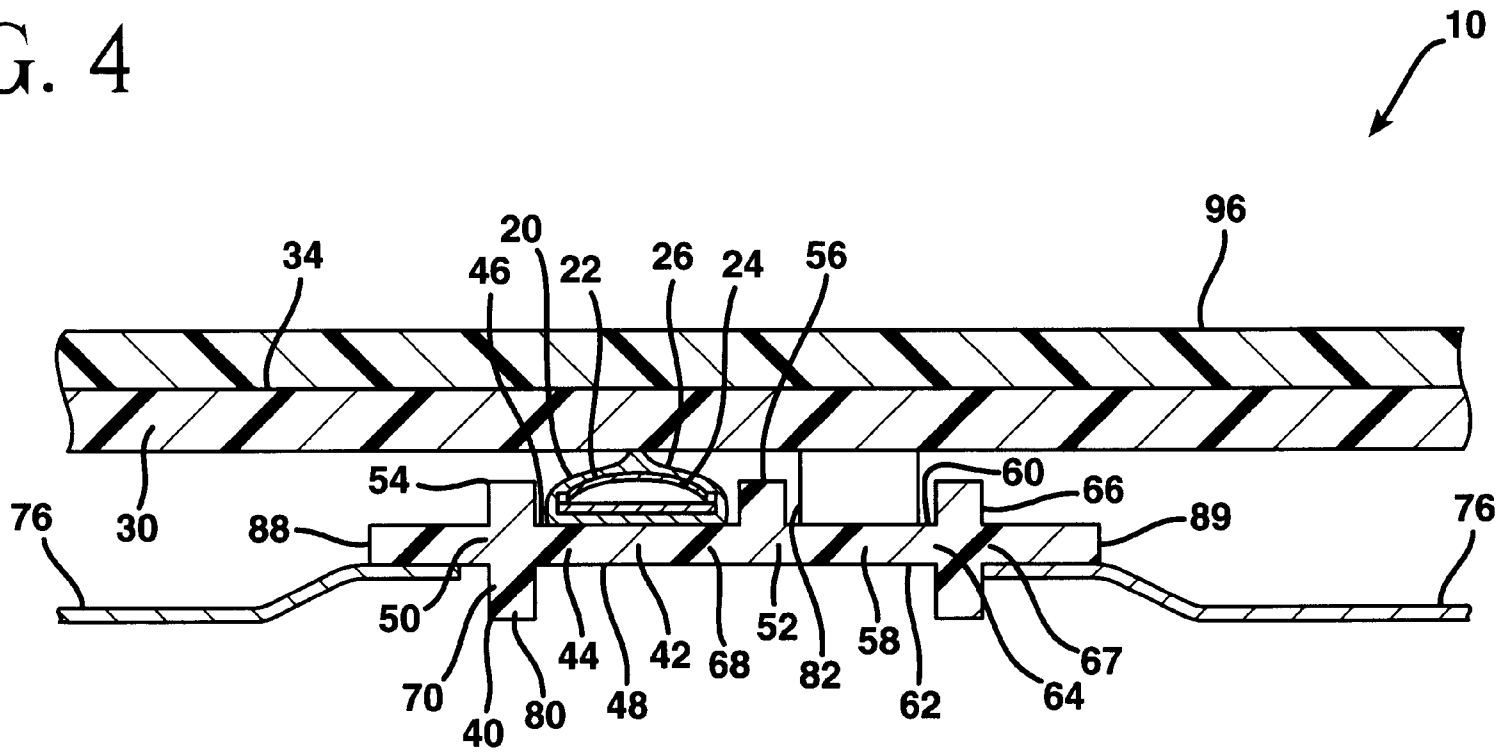
FIG. 4 is a sectional view taken along line 4—4 on FIG. 1A showing a zone separator.

Referring now to FIGS. 1A and 4, a preferred embodiment of the electrical switch mat 10 further includes a zone separator 80. The zone separator 80 is an additional frame member 70 which can be included as a part of the support frame 40. The attendant features of the zone separator 80 are similar to features of the protective housing 42 found on the support frame 40, except that the zone separator 80 further includes a second base-extension member 89 extending from the outside face 67 of the perimeter boundary 66 to facilitate the attachment of the dust barrier 76 to the zone separator 80. The zone separator 80 extends between two opposing sides of the support frame 40 and can partition the plate member 30 into separate zones. The zone separator 80 can be mechanically fastened as shown in FIG. 7 or connected by welding. The electrical contact 20 within each separate zone formed by the zone separator 80 may be wired independently of each other for monitoring each separate zone independently. The zone separator 80 can be used to provide additional intermediate support to the plate member 30 by including elastic members 82 as shown in FIG. 4. The zone separator 80 also serves to structurally stiffen the support frame 40 against swaying, i.e., provides resistance to rotational displacement of intersecting frame members 70.

Figure 3:
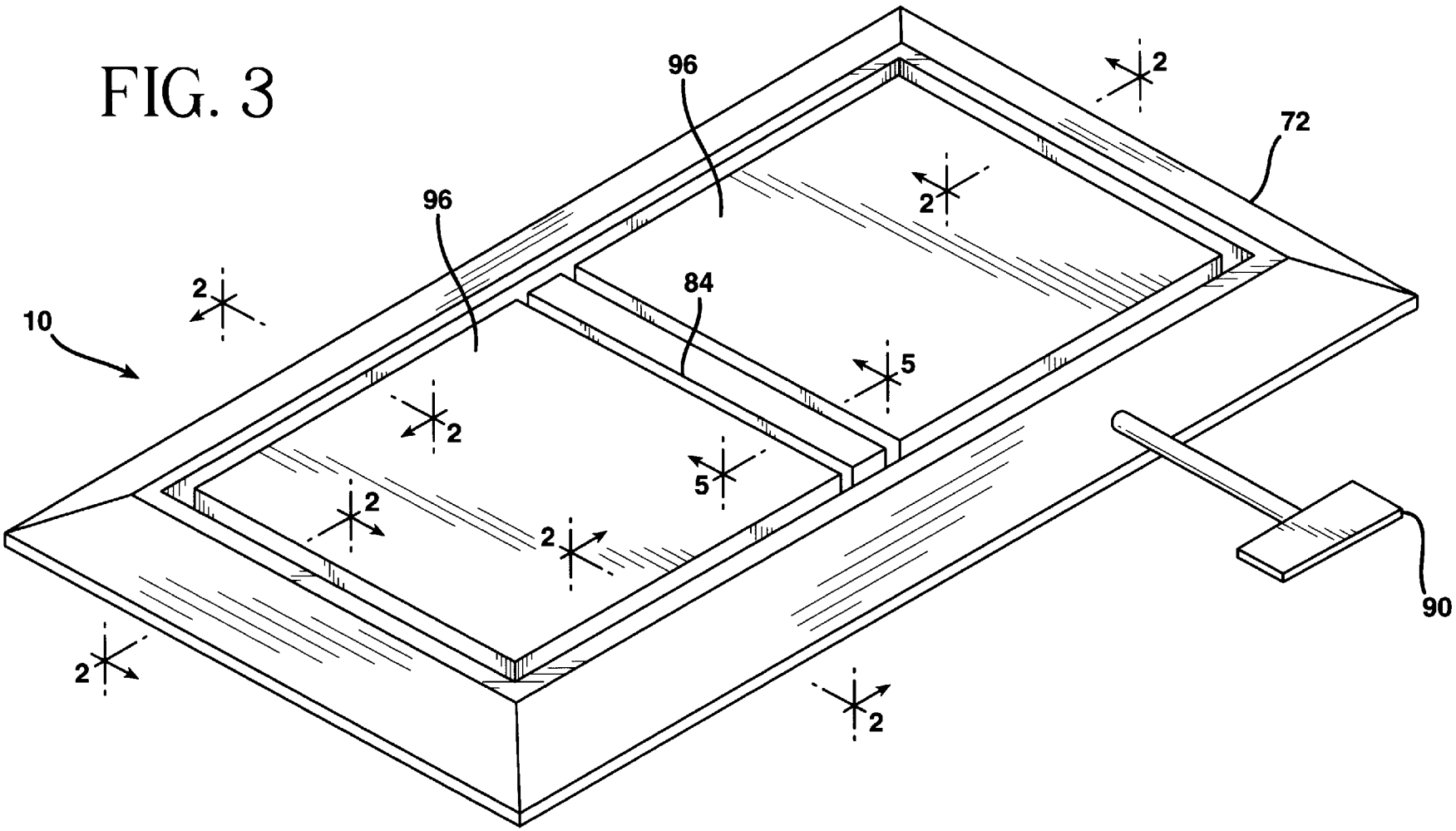
FIG. 3 is a perspective view of an electrical switch mat which includes a plurality of plate members.
Figure 5:
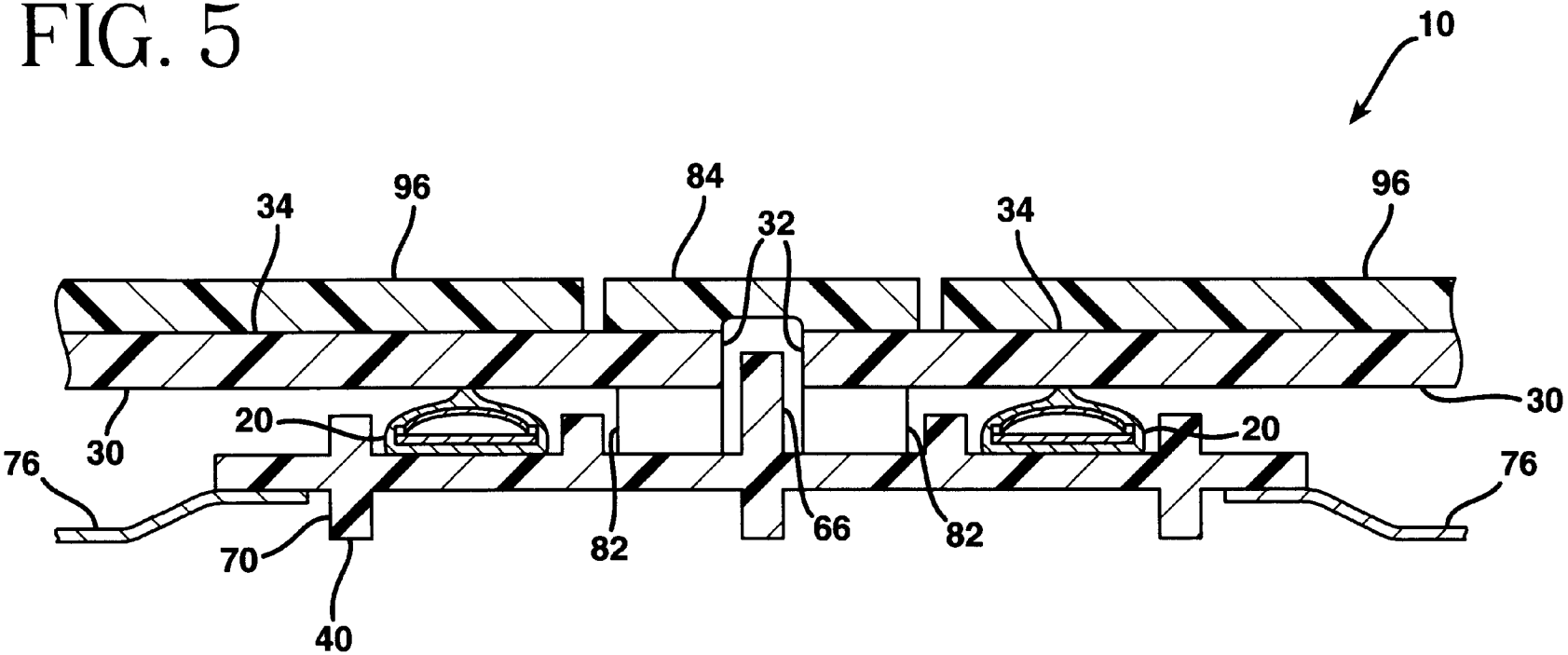
FIG. 5 is a sectional view taken along line 5—5 on FIG. 1A showing a connection strip joining adjacent portions of plate members.

Referring now to FIGS. 3 and 5, a preferred embodiment of the electrical switch mat 10 generally includes an electrical contact 20, a support frame 40, a plurality of plate members 30, and at least one connection strip 84. The connection strip 84 joins adjacent portions of the plurality of plate members 30 on the top side 34 at the perimeter 32 so that the plurality of plate members 30 are shaped and sized to fit within the two-dimensional area of the support frame 40 which enables the plurality of plate members 30 to respond as one integral part when subjected to pressure. The connection strip 84 is preferably made out of the same material as the plate member 30. Preferably the connection strip 84 is fastened to the adjacent portions of the plurality of plate members 30 by screws which allow the connection strip 84 to be easily removed when performing repair work. The support frame 40 is configured to support the plurality of plate members 30 along the perimeter 32 of each of the plurality of plate members 30. Preferably the support frame 40 is substantially symmetrically configured about the perimeter boundary 66 along the adjacent portions of the plurality of plate members 30 as shown in FIG. 5.

Thus, while there have been described what are presently believed to be the preferred embodiments of the invention, those skilled in the art will realize that changes and modifications may be made thereto without departing from the spirit of the invention, and is intended to claim all such changes and modifications as fall within the true scope of the invention.

What is claimed is:

1. An electrical switch mat comprising:

a ribbon switch operable under pressure between a closed condition and an open condition and maintained in one of said open and closed conditions in the absence of pressure;

a support frame defining a two-dimensional area and formed with a protective housing dimensioned to house said ribbon switch for activating under pressure to operate between said open and closed position and to prevent excessive compression from being transmitted to components of said ribbon switch during activation; and a plate member defined by a perimeter that is sized to fit within said two-dimensional area of said support frame and supported at said perimeter by said support frame, whereby said plate member transmits activating compression to said ribbon switch.

2. An electrical switch mat as defined in claim 1 wherein said plate member is shaped to be supported continuously along said perimeter.

3. An electrical switch mat as defined in claim 1 wherein said ribbon switch runs substantially continuously along said perimeter of said plate member.

4. An electrical switch mat as defined in claim 1 wherein said ribbon switch is intermittently placed along said perimeter of said plate member.

5. An electrical switch mat as defined in claim 1 wherein said ribbon switch includes a pair of vertically spaced electrical conductors enclosed in an insulative jacket, said conductors being urged into electrical engagement upon compression of said plate member to activate said ribbon switch.

6. An electrical switch mat as defined in claim 1 further comprising a dust cover, said dust cover being attached to said support frame and sealingly engaged with said plate member.

7. An electrical switch mat as defined in claim 1 further comprising a plurality of plate-member supports being attached to said plate member to prevent excessive deformation of said plate member.

8. An electrical switch mat as defined in claim 1 further comprising a dust barrier, said dust barrier being attached to said support frame.

9. An electrical switch mat as defined in claim 1 further comprising a ramp, said ramp being attached to said support frame.

10. An electrical switch mat as defined in claim 1 further comprising a plurality of elastic members for biasing said plate member with respect to said support frame.

11. An electrical switch mat as defined in claim 10 wherein said protective housing comprises:

a base having an upper surface, an outer surface, an inside boundary and an outside boundary;

a first flange extending upwards from said upper surface of said base at said inside boundary;

a second flange extending upwards from said upper surface of said base at said outside boundary;

a biasing-support member extending from said outside boundary of said base and having a top surface, a bottom surface, and outer end; and a perimeter boundary extending upwards from said outer end of said biasing-support member, wherein said ribbon switch is positioned on said upper surface of said base and between said first and second flanges, said first and second flanges serving to prevent excessive compression from being transmitted by said plate member to components of said ribbon switch during activation, and plurality of elastic members are seated on said top surface of said biasing-support member and between said second flange and said perimeter boundary.

12. An electrical switch mat comprising:

an electrical contact operable under pressure between a closed condition and an open condition and maintained in one of said open and closed conditions in the absence of pressure;

a support frame defining a two-dimensional area and formed with a protective housing dimensioned to house said electrical contact for activating under pressure to operate between said open and closed position and to prevent excessive compression from being transmitted to components of said electrical contact during activation;

a plurality of plate members, each of said plurality of plate members being defined by a perimeter and having a top side;

at least one connection strip for joining adjacent portions of said plurality of plate members on said top side perimeter so that said plurality of plate members are shaped and sized to fit within said two-dimensional area of said support frame and respond as one integral part when subjected to pressure; and wherein said support frame is configured to support said plurality of plate members along said perimeter of each of said plurality of plate members, whereby said plate members transmit activating compression to said electrical contact.

13. An electrical switch mat as defined claim 12 wherein said electrical contact is a ribbon switch.

14. An electrical switch mat as defined in claim 13 wherein said ribbon switch runs substantially continuously along said perimeter of at least one of said plurality of plate members.

15. An electrical switch mat as defined in claim 13 wherein said ribbon switch is intermittently placed along said perimeter of at least one of said plurality of plate members.

16. An electrical switch mat as defined in claim 13 wherein said ribbon switch includes a pair of vertically spaced electrical conductors enclosed in an insulative jacket, said conductors being urged into electrical engagement upon compression of at least one of said plurality members to activate said ribbon switch.

17. An electrical switch mat as defined in claim 12 wherein said protective housing comprises:

a base having an upper surface, an outer surface, an inside boundary and an outside boundary;

a first flange extending upwards from said upper surface of said base at said inside boundary;

a second flange extending upwards from said upper surface of said base at said outside boundary;

a biasing-support member extending from said outside boundary of said base and having a top surface, a bottom surface, and outer end; and a perimeter boundary extending upwards from said outer end of said biasing-support member, wherein said electrical contact is positioned on said upper surface of said base and between said first and second flanges, said first and second flanges serving to prevent excessive compression from being transmitted by said plurality of plate members to components of said electrical contact during activation, and said plurality of elastic members are seated on said top surface of said biasing-support member and between said second flange and said perimeter boundary.

18. An electrical switch mat as defined in claim 17 wherein said support frame is symmetrically configured along said adjacent portions of said plurality of plate members.

19. An electrical switch mat as defined in claim 12 further comprising a dust cover, said dust cover being attached to said support frame and sealingly engaged with at least one of said plurality of plate members.

20. An electrical switch mat as defined in claim 12 further comprising a plurality of plate-member supports being attached to at least one of said plurality of plate members to prevent excessive deformation of said at least one of said plurality of plate members.

21. An electrical switch mat as defined claim 12 further comprising a dust barrier being attached to said support frame.

22. An electrical switch mat as defined in claim 12 further comprising a ramp, said ramp being attached to said support frame.

23. An electrical switch mat as defined in claim 12 further comprising a zone separator for partitioning at least one of said plurality of plate members, said zone separator being attached to said support frame.

24. An electrical switch mat comprising:

an electrical contact operable under pressure between a closed condition and an open condition and maintained in one of said open and closed conditions in the absence of pressure;

a support frame defining a two-dimensional area and formed with a protective housing having a channel dimensioned to house said electrical contact within said channel for activating under pressure to operate between said open and closed position and to prevent excessive compression from being transmitted to components of said electrical contact during activation; and a plate member defined by a perimeter that is sized to fit within said two-dimensional area of said support frame and supported at said perimeter by said support frame, whereby said plate member transmits activating compression to said electrical contact.

25. An electrical switch mat as defined in claim 24 wherein said plate member is shaped to be supported continuously along said perimeter.

26. An electrical switch mat as defined in claim 24 further comprising a plurality of plate-member supports being attached to said plate member to prevent excessive deformation of said plate member.

27. An electrical switch mat as defined in claim 24 further comprising a plurality of elastic members for biasing said plate member with respect to said support frame.

28. An electrical switch mat as defined in claim 27 wherein said protective housing comprises:

a base having an upper surface, an outer surface, an inside boundary and an outside boundary;

a first flange extending upwards from said upper surface of said base at said inside boundary;

a second flange extending upwards from said upper surface of said base at said outside boundary;

a biasing-support member extending from said outside boundary of said base and having a top surface, a bottom surface, and outer end; and a perimeter boundary extending upwards from said outer end of said biasing-support member, wherein said electrical contact is positioned on said upper surface of said base and between said first and second flanges, said first and second flanges serving to prevent excessive compression from being transmitted by said plate member to components of said electrical contact during activation, and said plurality of elastic members are seated on said top surface of said biasing-support member and between said second flange and said perimeter boundary.

29. An electrical switch mat comprising:

an electrical contact operable under pressure between a closed condition and an open condition and maintained in one of said open and closed conditions in the absence of pressure;

a support frame defining a two-dimensional area and formed with a protective housing dimensioned to house said electrical contact for activating under pressure to operate between said open and closed position and to prevent excessive compression from being transmitted to components of said electrical contact during activation;

a plate member defined by a perimeter that is sized to fit within said two-dimensional area of said support frame and supported at said perimeter by said support frame; and a zone separator attached to said support frame for partitioning said plate member, whereby said plate member transmits activating compression to said electrical contact.

30. An electrical switch mat as defined in claim 29 wherein said plate member is shaped to be supported continuously along said perimeter.

31. An electrical switch mat as defined claim 29 further comprising a plurality of plate-member supports being attached to said plate member to prevent excessive deformation of said plate member.

32. An electrical switch mat as defined claim 29 further comprising a plurality of elastic members for biasing said plate member with respect to said support frame.

33. An electrical switch mat as defined claim 32 wherein said protective housing comprises:

a base having an upper surface, an outer surface, an inside boundary and an outside boundary;

a first flange extending upwards from said upper surface of said base at said inside boundary;

a second flange extending upwards from said upper surface of said base at said outside boundary;

a biasing-support member extending from said outside boundary of said base and having a top surface, a bottom surface, and outer end; and a perimeter boundary extending upwards from said outer end of said biasing-support member, wherein said electrical contact is positioned on said upper surface of said base and between said first and second flanges, said first and second flanges serving to prevent excessive compression from being transmitted by said plate member to components of said electrical contact during activation, and said plurality of elastic members are seated on said top surface of said biasing-support member and between said second flange and said perimeter boundary.

34. An electrical switch mat comprising:

an electrical contact operable under pressure between a closed condition and an open condition and maintained in one of said open and closed conditions in the absence of pressure;

a support frame defining a two-dimensional area and formed with a protective housing dimensioned to house said electrical contact for activating under pressure to operate between said open and closed position, said protective housing including:

a base having an upper surface, an outer surface, an inside boundary and an outside boundary;

a first flange extending upwards from said upper surface of said base at said inside boundary;

a second flange extending upwards from said upper surface of said base at said outside boundary;

a biasing-support member extending from said outside boundary of said base and having a top surface, a bottom surface, and outer end; and a perimeter boundary extending upwards from said outer end of said biasing-support member;

a plate member defined by a perimeter that is sized to fit within said two-dimensional area of said support frame and supported at said perimeter by said support frame; and a plurality of elastic members for biasing said plate member with respect to said support frame; and wherein said electrical contact extends along said perimeter of said plate member and is positioned on said upper surface of said base and between said first and second flanges, said first and second flanges serving to prevent excessive compression from being transmitted by said plate member to components of said electrical contact during activation, and said plurality of elastic members are seated on said top surface of said biasing-support member and between said second flange and said perimeter boundary.

35. An electrical switch mat as defined in claim 34 wherein said plate member is shaped to be supported continuously along said perimeter.

36. An electrical switch mat as defined in claim 34 further comprising a plurality of plate-member supports being attached to said plate member to prevent excessive deformation of said plate member.

* * * * *

UNITED STATES PATENT AND TRADEMARK OFFICE

CERTIFICATE OF CORRECTION

PATENT NO. : 6,054,658

DATED : April 25, 2000

INVENTOR(S) : Duhon et al.

It is certified that error appears in the above-indentified patent and that said Letters Patent is hereby corrected as shown below:

In Column 3, line 51, now reads "1A showing a connection strip"

should read--3 showing a connection strip--

In Column 9, line 26, now reads "defined claim 12"

should read --defined in claim 12--

In Column 10, line 10, now reads "defined claim 12"

should read --defined in claim 12--

Signed and Sealed this

Twentieth Day of March, 2001

Nicholas P. Godici

*Attest:*

NICHOLAS P. GODICI

*Attesting Officer*

*Acting Director of the United States Patent and Trademark Office*